US005820350A

United States Patent [19]

Mantey et al.

[11] Patent Number: 5,820,350

[45] Date of Patent: Oct. 13, 1998

[54] METHOD AND APPARATUS FOR CONTROLLING DOWNHOLE ROTARY PUMP USED IN PRODUCTION OF OIL WELLS

[75] Inventors: Edward Karl Mantey; Ben B. Wolodko, both of Edmonton, Canada

[73] Assignee: Highland/Corod, Inc., Canada

[21] Appl. No.: 596,510

[22] Filed: Feb. 5, 1996

[30] Foreign Application Priority Data

Nov. 17, 1995 [CA] Canada ..... 2163137

[51] Int. Cl.[6] ..... F04B 49/06

[52] U.S. Cl. ..... 417/45; 417/44.1; 417/53

[58] Field of Search ..... 417/18, 22, 42, 417/45, 44.11, 53, 44.1

[56] References Cited

U.S. PATENT DOCUMENTS

| | | | |
|---|---|---|---|
| 4,145,161 | 3/1979 | Skinner | 417/22 |
| 4,601,640 | 7/1986 | Sommer | 417/12 |
| 4,971,522 | 11/1990 | Butlin | 417/18 |
| 5,204,595 | 4/1993 | Opal et al. | 318/430 |
| 5,251,696 | 10/1993 | Boone et al. | 166/250 |
| 5,362,206 | 11/1994 | Westerman et al. | 417/44.11 |
| 5,425,623 | 6/1995 | London et al. | 417/44.11 |
| 5,441,389 | 8/1995 | Wolcott et al. | 417/18 |

*Primary Examiner*—Ayaz R. Sheikh
*Assistant Examiner*—Xuan M. Thai
*Attorney, Agent, or Firm*—Browning Bushman

[57] ABSTRACT

A downhole rotary pump driven by a polished rod and a string of sucker rods from the earth's surface by a variable or fixed frequency, three phase electric motor, is controlled by measurements of power consumed by the electric motor and by measurements of the rotary speed of the polished rod, the combinations of such measurements being indicative of the torque exerted on the polished rod. Determinations of such torque being either within or outside of predetermined upper and lower torque limits are used to either maintain the rotary speed of the downhole pump, or to vary the rotary speed of the downhole pump, or alternatively, to completely shutdown the downhole pump. Power generated by the motor is monitored and the measured value of power may also be used to terminate motor operation when a low power limit is exceeded.

16 Claims, 1 Drawing Sheet

METHOD AND APPARATUS FOR CONTROLLING DOWNHOLE ROTARY PUMP USED IN PRODUCTION OF OIL WELLS

BACKGROUND OF THE INVENTION

This invention relates, generally, to a method and apparatus for controlling a downhole rotary pump used in pumping oil to the earth's surface, and more particularly, to a method and apparatus for stopping or changing the rotary speed of a downhole rotary pump in response to measurements of the power supplied to the electric motor driving the downhole pump and measurements of the RPM of the polished rod causing the downhole pump to rotate.

PRIOR ART

For the production of oil wells having insufficient downhole pressure to cause the oil to come to the earth's surface, the prior art has been replete with various forms of systems for pumping the oil to the earth's surface. Such systems include so-called pumping jacks which cause sucker rods to reciprocate in one or more vertical planes, driving a reciprocating pump. As used herein, the term "sucker-rods" is intended to include any power conveying linkage of solid or tubular members which connect together in threaded sections or a continuous string of material which may be mainpulated to power a subsurface mechanism such as an oil pump.

Other pumps in this art include subsurface rotary pumps driven by rotating sucker rods caused to rotate by an electric motor at the earth's surface.

With all such downhole pumps, be they reciprocating or rotary, there is always a concern that gas will enter the pump, or that the oil pooled in the borehole will fall below the pump intake level. These undesirable pumping conditions are indicated by a reduction in the amount of reaction torque produced in the pump. Where the pump is driven by an electric motor, the prior art systems typically monitor the current flow in the motor to indicate torque loading in the pump.

Mr. Sam Gibbs, with the Nabla Corporation, has developed various methods, algorithms and mathematical models for predicting bottom hole pressures, including the use of electric motor current to predict downhole conditions.

Historically, operators of downhole pumps driven by electric motors have merely clipped on an ammeter as a tool at the earth's surface to provide an indication of loading on the downhole pump. These prior art systems are designed as pump off controllers which regulate operation of the subsurface pump in response to amperage changes in the motor power supply. However, it has been noted that an amperage measurement alone, without knowing the motor characteristics such as horsepower or torque versus amperage relationship, is not a reliable indication of power consumption in that current flow is non-linear over the range of the power output of the three phase electric motors typically used in this industry to drive downhole rotary pumps. As a result, systems designed to automatically stop motor operation based solely on motor amperage provide a limited range of control which does not closely match the motor operation with the actual subsurface pumping conditions. To ensure fail-safe operation of such systems, the motor must be shut down well before the limits of an undesirable pumping situation are encountered. The result is either early or unnecessary pump shut-down, either of which reduce production and necessitate restarting procedures.

These prior art systems which automatically shut-down the subsurface pump are not suitable for use with well fluids which contain relatively large amounts of solid particulate materials. In such applications, sand or other particulate suspended within the oil or other fluid being pumped from the well settles out of suspension when pumping is terminated. The result is that a relatively large amount of particulate settles down onto and into the pump causing it to pack-in and become inoperative. Recovery of a packed-in pump can necessitate expensive and time consuming procedures.

OBJECTS OF THE INVENTION

The primary object of the present invention is to provide new and improved methods and apparatus which monitor the torque on the polished rod driving the downhole rotary pump and measure the power output of the motor driving the pump. The monitored variables are used to control motor operation to stop or vary the rotary speed of such pump based upon rod torque falling within or outside predetermined torque limits or to stop the motor when the work being done by the pump drops below a predetermined limit.

SUMMARY OF THE INVENTION

The objects of the invention are accomplished, generally, by methods and apparatus which measure the power provided to an electrical motor which rotates a polish rod to drive a downhole pump. The applied torque on the polished rod shaft is calculated from the measured values for power consumed by the electric motor and the rotary speed of the polished rod. The motor speed is either varied or shut down based upon whether the applied torque is within predetermined upper and lower limits and/or the motor is shut down when the power output of the motor drops below a preset limit.

BRIEF DESCRIPTION OF THE DRAWINGS

These and other objects, features and advantages of the invention will be more readily understood based upon a reading of the following detailed specification and drawings, in which.

DETAILED DESCRIPTION OF THE PREFERRED EMBODIMENT

Figure 1:
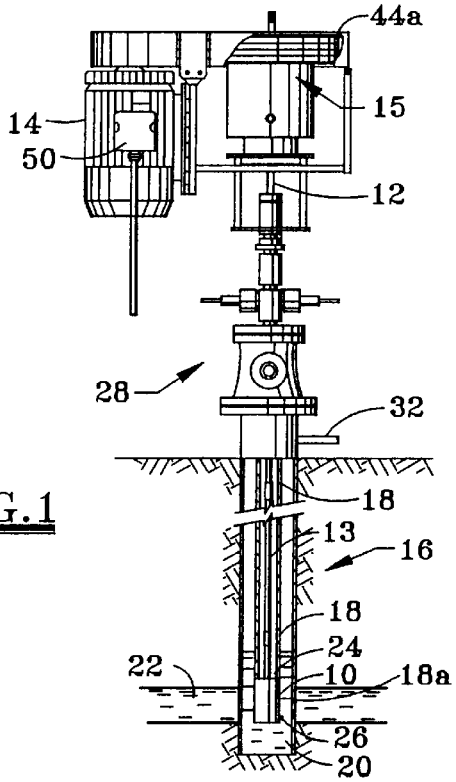
FIG. 1 is an elevated, schematic view, partly in cross-section, of a producing oil well using a rotary downhole pump driven by a polished rod/sucker rod string from an electric motor at the earth's surface controlled in accord with the present invention.

FIG. 1 is an elevated, schematic view, partly in cross-section, of a producing oil well 16 using a rotary downhole pump 10 driven by a polished rod shaft 12 from the earth's surface, controlled in accord with the present invention. The oil well 16 is illustrated as having steel casing 18, but the methods and apparatus of the present invention will perform equally well in uncased wells.

The conventional rotary pump 10 is carried at the lower end of production tubing 18, or at the end of a sucker rod string 13, with the polished rod shaft 12 and the string of sucker rods 13 being located within the interior of the tubing 18. In establishing the location of the pump 10 in the well 16, an adequate number of joints of the production tubing 18 and of the sucker rods 13 are added at the earth's surface to cause the pump 10 to be submerged in the oil 20 pooled in the well 16. The oil 20 reaches the interior of the well 16 through perforations 18*a* in the steel casing 18, coming from the oil reservoir 22 in a manner well known to those skilled in the art.

Because the diameters of the polished rod 12 and the sucker rods 13 are smaller than the inside diameter of the production tubing 18, an annulus 24 external to the polished rod but interior to the production tubing 18, provides a path for the produced oil 20 to reach the earth's surface.

As the oil 20 enters the inlet port 26 of the rotary pump 10, the oil is pumped up through the annulus 24 to the earth's surface, passes through the conventional wellhead equipment 28, and into an oil storage tank (not illustrated) through the pipe 32 or into a multiple well oilfield gathering system (not illustrated).

In the operation of the system described so-far in FIG. 1, the electric motor 14 rotates a polished rod shaft 12 and the sucker rods 13 through a belt driven drive head linkage 15, causing the impellers of the pump 10 to rotate and pump the oil 20 up through the production tubing 18, into the pipe 28 and on to an oil storage tank or gathering system, all in a conventional manner.

Those skilled in this art have long recognized that if the oil in the reservoir 22 enters the well 16 through the perforations in the steel casing at a rate which is less than the rate at which the pooled oil 20 is being pumped out of the well 16, the pooled oil 20 will fall below the pump inlet 26 and cause undesirable results. In these cases, it is customary to shut off the pump when the oil falls below the pump inlet.

In pumping heavy oil with a high sand content, it is generally undesirable to completely shut the rotary pump down, sometimes referred to as "pump-off control." When the pump is shut totally down, the sand or other particulate will often settle out and sand-in or pack-in the pump, necessitating the removal of the production tubing, the polished rod shaft, the sucker rods and the pump from the well to repair or replace the pump. In these wells, instead of shutting down the pump completely, it is much more desirable to merely slow down the pump. This allows the oil to pool in the casing faster than it is being pumped out to thereby maintain the particulates in suspension within a steadily flowing oil stream.

The system and method of the present invention monitor multiple variations in the electric motor and pump drive system to obtain a more accurate control over the system operation. As a result, the system may be operated much closer to the pumping limits of the well to increase the well production rate and to minimize system restart procedures.

In a preferred form of the invention, the internal power consumed by an electric motor is monitored to provide a control for the system.

The formula for power consumed by a three phase electric motor is:

$$\text{Horsepower} = \frac{\text{Power (watts)}}{746} = \frac{\text{Volts} \times \text{Amps} \times \text{COS}\ \alpha \times \sqrt{3}}{746} \quad (1)$$

where $\alpha$ is the phase angle between the voltage and current waveforms. This phase angle is sometimes referred to as the Power Factor.

Moreover, it is well known that the formula for the output torque on a motor shaft is:

$$\text{Torque (foot pounds)} = \frac{\text{Horsepower} \times K}{\text{RPM}} \quad (2)$$

where K is a constant (usually 5252) and RPM is the rotary speed of the motor shaft in rotations per minute.

Thus, by combining the input voltage, amperage and phase angle signals for the powering motor used in the power formula (1) with a measurement of the rotational speed of the polished rod being directly driven by the motor shaft, one can ascertain the value of the applied torque exerted on the polished rod driving the downhole rotary pump. The calculated values of torque are reduced by the motor losses and the mechanical power losses in conveying the developed motor torque to the polished rod. These losses include the friction power required in the surface drive mechanism (i.e., belts, sheave, spindle shaft, bearings, stuffing box, etc.). There are also internal rotational motor losses caused by friction, windage, and eddy current hysteresis. Thus, the actual torque being applied to the pump is somewhat less than the calculated torque on the motor output shaft. These losses, however, can be closely estimated using conventional techniques so that the torque values used in controlling the system are substantially accurate.

When the system of the present invention is used to control a fixed speed motor, the motor is turned off whenever the torque output of the motor exceeds a preset maximum value or drops below a preset minimum value. In the case of a system with a variable speed motor, the motor speed is varied to keep the torque output between preselected torque values. Additionally, the motor may be shut down when the power output of the motor drops below some preselected value which occurs, for example, when no fluid is being pumped or when the linkage between the pump and motor has been severed.

If the motor 14 is of the type having a variable speed control, the effective speed of the electric motor can be varied by a variety of ways. For example, the frequency of the three phase input power can be varied, sometimes referred to as a "variable frequency drive." Alternatively, but not as preferred, when using a constant speed motor, a mechanical differential output of the electric motor can be used to vary the driving force exerted on the polished rod. The system of the present invention is intended to function with all forms of surface drives driven by fixed or variable speed electric motors.

The measurement of the power generated by the three phase a.c. motor 14 is accomplished through the use of any suitable method. As a preferred example, the power may be measured by a power transducer which uses three balanced Hall Effect sensors to provide an analog output proportional to the power consumed by the motor. One of the Hall Effect sensors is placed in a gap in a magnetic flux concentrator (donut), to produce an analog signal indicative of current, voltage and phase angle in a given phase of the three phase system. The Hall Effect sensor is also excited with a signal that comes from a voltage sample for that one phase of the three phase system. Because a Hall Effect sensor can multiply two signals, the resulting output for that one phase is proportional to power, i.e., Volts×Amps×COS $\alpha$.

The power sensor unit uses two other Hall Effect sensors in the other two phases of the three phases system, one in each phase. Moreover, this measurement unit provides an instantaneous vector multiplication which calculates the lead or lag of the current, i.e., the Power Factor. The signals from each of the three phases are then summed, producing an analog output signal proportional to the three phase power consumed by the electric motor 14. This style of power measurement using balanced Hall Effect sensors, is particularly useful for the present invention, in that it can be used with either fixed or variable frequency electric motor drive systems.

Figure 2:
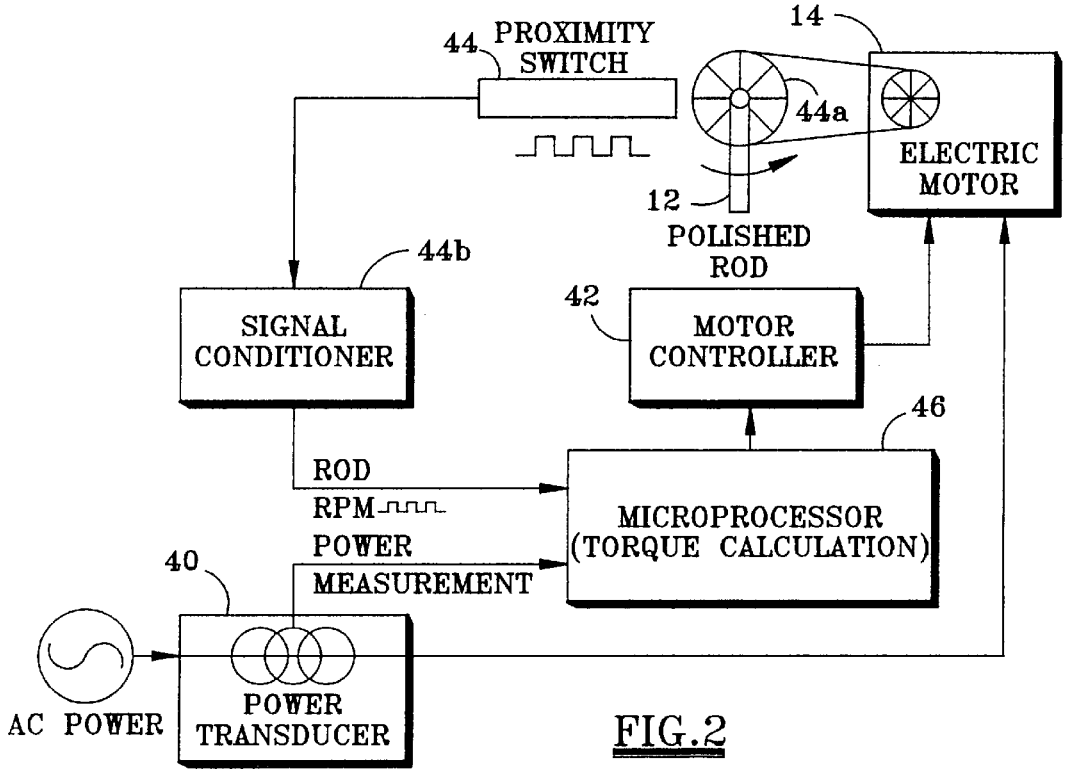
FIG. 2 is a block diagram of the circuitry used to calculate the applied torque, and to control the electric motor in accord with the present invention.

FIG. 2 illustrates schematically a power measurement device 40, within the motor control circuitry 50 illustrated in FIG. 1, used in accord with the present invention to measure the internal power generated by the variable or fixed frequency, electric motor 14. In addition, FIG. 2 schematically illustrates the motor controller 42 and a conventional proximity switch 44 which generates digital pulses indicative of the rotational speed of the polished rod 12. Although there is a plurality of ways in which to measure the RPM of the polished rod 12, such as measuring the time for one complete revolution of the polished rod, or by counting the number of revolutions for a given period of time, or by counting the corners of the polished rod clamp and dividing by four, or by counting the spokes of the drive sheave and dividing by six, and so on, the measurement is quite conventional. The proximity switch sensor 44 is preferably mounted in the drive head in a location where it would be mechanically protected and be reasonably free of dirt and grease. Such a proximity switch 44 typically is a non-contact device which senses the presence of a ferrous material. A somewhat suitable arrangement is to have the sensor 44 aligned to sense the six spokes on a driven sheave 44*a* which rotates with the polished rod as indicated schematically in FIG. 2. Assuming a maximum frequency of 700 RPM for the driven polished rod, and a sheave with six spokes, the device 44 will have a maximum input pulse rate of 70 Hz, calculated as follows:

$$\frac{700\ \text{RPM}}{60} \times 6 = 70\ \text{Hz} \tag{3}$$

The signals generated by the proximity sensor 44 are coupled through a signal conditioner 44*b* into a microprocessor 46 which performs the calculations of equations 1 and 2 in any suitable manner. The resulting torque computation is used to operate the motor controller 42 which in turn controls the motor 14. Thus, the microprocessor may be programmed to produce a control signal which commands the motor control 42 to increase the speed of the motor 14 in order to maintain the torque applied to the pump above a low torque level programmed into the computer. The system may command the motor to decrease speed to maintain the applied torque below another preset value. It will also be understood that the system may operate to provide motor speed changes which maintain a substantially constant applied torque to the pump. It may be desireable to program the system such that, so long as the determined torque on the polished rod 12 stays within the predetermined upper and lower limits, the motor 14 runs at a constant frequency. If the determined torque falls below the predetermined lower limit, or rises above the predetermined upper limit, the frequency of operation of the electric motor is raised or lowered as appropriate. Similarly, the system may be programmed to stop operation of the motor when the power output of the motor falls below some preset minimum value.

The microprocessor may also be programmed to restart the system after a shut-down. Depending on the application, the system may restart after a preset time delay or may restart after a sensor (not illustrated) signals the change in some monitored parameter such as pump temperature, fluid level or return of power supply energy.

In the operation of the preferred system described and illustrated herein, the torque on the polished rod 12 is continuously monitored by monitoring the power output of the motor 14 as well as the RPM of the polished rod. If the torque exceeds the predetermined upper limit, the system provides either a reduction of the rotary pump speed (more preferred) or a complete shut-down of the rotary pump (less preferred). For a down-hole condition where gas enters the pump, or if the pump "pumps-off", i.e., the oil has fallen below the entry port 26 in the pump 10, the torque will usually fall below the predetermined lower torque limit, in which case the rotary pump is likewise either slowed down (more preferred) or completely shut down (less preferred). Where the pump is driven by a variable frequency motor, the sensing of low power delivery to the pump is a preferred indicator for controlling motor shut down.

It will also be appreciated that the system of the present invention may be employed to control pump operation when torque fluctuations are the result of mechanical failure in the motor-pump linkage, pump problems, motor problems, power supply variations or other factors which would cause torque changes in the monitored system or power output changes in the monitored elective motor.

Although not discussed in any detail herein, those skilled in this art may wish to incorporate into this present system according to the invention, an additional system for monitoring the pump intake pressure along with the torque existing on the polished rod. This input data may be supplied to the microcomputer and approximately included in the calculations performed by the system to optimize pumping performance. It is considered that various algorithms will be obvious to those skilled in this art to combine the torque determinations with the measured pump intake pressure to improve even further on controlling the downhole rotary pump.

The foregoing disclosure and description of the invention is illustrative and explanatory thereof, and it will be appreciated by those skilled in the art that various changes in the size, shape and materials as well as in the details of the illustrated construction or combinations of features of the various system elements and the method discussed herein may be made without departing from the spirit of the invention.

What is claimed is:

1. Apparatus for pumping oil from an oil well, comprising:

a variable or fixed speed electric motor located at the earth's surface;

a polished rod driven by said electric motor;

a string of jointed or continuous sucker rods suspended from the lower end of said polished rod;

a rotary pump connected to the lower end of said string of sucker rods, said rotary pump being rotatable by the rotation of said polished rod and said string of sucker rods;

apparatus for determining the torque exerted on said polished rod; and circuitry for changing the rotary speed of said rotary pump based upon said torque being greater than a predetermined upper limit.

2. The apparatus according to claim 1, wherein said torque is determined by measuring the power consumed by said electric motor, by measuring the rotational speed of said polished rod, and by generating a control signal functionally related both to the power consumed and to the rotational speed of the polished rod.

3. The apparatus according to claim 2, wherein said control signal is used to vary the speed of said electric motor based upon said control signal being greater than a predetermined upper value.

4. The apparatus according to claim 1, including in addition thereto, circuitry for measuring the power output of said motor and varying the rotary speed of said rotary pump based upon said power output being less than a predetermined lower limit.

5. An apparatus for pumping fluid from a well comprising:

an electric motor;

a rotary drive powered by said motor and extending down into said well;

a rotary pump operatively connected to the lower end of said rotary drive apparatus for pumping fluid from said well;

an apparatus for measuring torque applied to said rotary drive by said motor; and control circuitry for operating said pump in response to the value of torque being applied to said rotary drive.

6. An apparatus for pumping fluid from a well as defined in claim 5 wherein said apparatus for measuring torque measures the electrical power consumed by said electric motor and measures the speed of rotation of said rotary drive and employs said measured power consumed and said speed of rotation to calculate the value of the torque being applied to said rotary drive.

7. An apparatus as defined in claim 5 wherein said control circuitry terminates operation of said motor when the torque being applied to said rotary drive meets or exceeds a predetermined torque value.

8. An apparatus as defined in claim 5 wherein said control circuitry controls the speed of said motor to control the torque applied to said rotary drive.

9. An apparatus as defined in claim 8 further including power measuring circuitry for measuring the power output of said motor wherein said control circuitry controls the speed of said motor to maintain the torque applied to said rotary drive between preselected upper torque values and lower power values.

10. An apparatus for pumping fluid from a well as defined in claim 7 wherein said apparatus for measuring torque measures the electrical power consumed by said electric motor and measures the speed of rotation of said rotary drive and employs said measured power consumed and said speed of rotation to calculate the value of the torque being applied to said rotary drive.

11. An apparatus for pumping fluid from a well as defined in claim 8 wherein said apparatus for measuring torque measures the electrical power consumed by said electric motor and measures the speed of rotation of said rotary drive and employs said measured power consumed and said speed of rotation to calculate the value of the torque being applied to said rotary drive.

12. An apparatus for pumping fluid from a well as defined in claim 9 wherein said apparatus for measuring torque measures the electrical power consumed by said electric motor and measures the speed of rotation of said rotary drive and employs said measured power consumed and said speed of rotation to calculate the value of the torque being applied to said rotary drive.

13. A method for controlling a rotary downhole pump driven by a variable speed electric motor used for pumping fluid out of a well, comprising:

determining the torque exerted on a polished rod driven by said electric motor; and controlling the speed of said electric motor as a function of said determined torque.

14. The method according to claim 13, including in addition thereto, the step of measuring the power output of said electric motor and controlling the speed of said electric motor as a function of said determined torque being more than a predetermined torque value or, said power output being less than a predetermined power value.

15. A method for controlling a rotary downhole pump driven by a fixed speed electric motor used for pumping fluid out of a well, comprising:

determining the torque exerted on the polished rod driven by said electric motor;

determining the output power of said electric motor; and stopping said electric motor as a function of said determined torque being greater than a predetermined torque value or, said power being less than a predetermined power value.

16. A method according to claim 15, including in addition thereto, the step of measuring the torque exerted on the polished rod by measuring the power consumed by the motor and the rotary speed of the polished rod.

* * * * *